US009500987B2

(12) United States Patent
Yamamoto

(10) Patent No.: US 9,500,987 B2
(45) Date of Patent: Nov. 22, 2016

(54) IMAGE FORMING APPARATUS

(71) Applicant: CANON KABUSHIKI KAISHA, Tokyo (JP)

(72) Inventor: Tatsuyuki Yamamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/338,425

(22) Filed: Jul. 23, 2014

(65) Prior Publication Data

US 2015/0037071 A1 Feb. 5, 2015

(30) Foreign Application Priority Data

Jul. 31, 2013 (JP) ..... 2013-159922

(51) Int. Cl.
*G03G 15/08* (2006.01)

(52) U.S. Cl.
CPC ..... *G03G 15/0879* (2013.01); *G03G 15/0822* (2013.01); *G03G 15/0832* (2013.01); *G03G 15/0837* (2013.01); *G03G 15/0839* (2013.01); *G03G 15/0865* (2013.01); *G03G 2215/0132* (2013.01); *G03G 2215/0692* (2013.01)

(58) Field of Classification Search
CPC ..... G03G 15/08
USPC ..... 399/258
See application file for complete search history.

(56) References Cited

U.S. PATENT DOCUMENTS 7,933,536 B2 * 4/2011 Ogawa ..... G03G 21/1864 399/111
8,270,883 B2 * 9/2012 Ozawa ..... G03G 15/0126 399/258
8,428,491 B2 4/2013 Yamamoto
8,478,164 B2 7/2013 Yamamoto
8,565,649 B2 10/2013 Murakami et al.
8,611,788 B2 12/2013 Yamamoto
2006/0104670 A1 * 5/2006 Nishitani ..... G03G 15/0868 399/258

(Continued)

FOREIGN PATENT DOCUMENTS

JP 2009-288358 * 12/2009 ..... G03G 15/00
JP 2009288358 A 12/2009
JP 2010-256893 A 11/2010

OTHER PUBLICATIONS

U.S. Appl. No. 14/448,029, Filed on Jul. 31, 2014.

*Primary Examiner* — David Gray
*Assistant Examiner* — Kevin Butler
(74) *Attorney, Agent, or Firm* — Fitzpatrick, Cella, Harper & Scinto

(57) ABSTRACT

A supplying device includes first and second bottles each including a bottle gear for inputting a driving force. A driving source drives a driving gear, and a swingable gear is in engagement with the driving gear. The swingable gear swings between a first drive transmitting position where the driving force is transmitted from the swingable gear to the first bottle gear in engagement with the first bottle gear, and a first retracted position, where the swingable gear is retracted from the first drive transmitting position. In addition, a movable gear is movable between a second drive transmitting position, where the driving force is transmitted from the swingable gear to the second bottle gear in engagement with both of the second bottle gear and the swingable gear located in the first retracted position, and a second retracted position where the movable gear is retracted from the second drive transmitting position.

8 Claims, 8 Drawing Sheets

(56) References Cited

U.S. PATENT DOCUMENTS

| | | | | |
|---|---|---|---|---|
| 2006/0165423 | A1* | 7/2006 | Nishitani | G03G 15/0121 399/27 |
| 2012/0014713 | A1* | 1/2012 | Murakami | G03G 15/0865 399/119 |
| 2012/0057905 | A1* | 3/2012 | Itabashi | G03G 15/0886 399/258 |
| 2013/0216263 | A1 | 8/2013 | Miyazawa et al. | |
| 2013/0223861 | A1 | 8/2013 | Kubo et al. | |
| 2014/0016967 | A1 | 1/2014 | Murakami et al. | |
| 2014/0169835 | A1* | 6/2014 | Nakajima | G03G 15/0874 399/258 |
| 2014/0376968 | A1* | 12/2014 | Yamamoto | G03G 15/0886 399/258 |
| 2015/0010334 | A1* | 1/2015 | Nakajima | G03G 15/0877 399/258 |
| 2015/0037071 | A1* | 2/2015 | Yamamoto | G03G 15/0879 399/258 |
| 2015/0043944 | A1* | 2/2015 | Yamamoto | G03G 21/1676 399/258 |

* cited by examiner

IMAGE FORMING APPARATUS

FIELD OF THE INVENTION AND RELATED ART

The present invention relates to an image forming apparatus such as a copying machine, a printer, a facsimile machine and a multi-function machine having functions of these machines. Particularly, the present invention relates to a structure in which a supply container for supplying a developer to a developing device is detachably mountable to an apparatus main assembly of the image forming apparatus.

In a conventional image forming apparatus of an electrophotographic type such as the copying machine, a fine powdery developer is used. In such an image forming apparatus, a developer to be consumed with image formation is supplied from a developer supply container. The developer in the developer supply container is stirred and fed to be supplied into a developing device provided in the image forming apparatus. For this reason, a driving force for stirring and feeding the developer is required for the developer supply container, and in general, a drive transmission path from an apparatus main assembly of the image forming apparatus toward the developer supply container is ensured and the driving force is transmitted through the path. Further, a constitution in which the developer supply container is detachably mountable to the apparatus main assembly has been conventionally known, and in the case of such a constitution, power can be transmitted and interrupted between the apparatus main assembly and the developer supply container. With respect to such a drive transmitting type from the apparatus main assembly toward the developer supply container, various types have been proposed and put into practical use.

For example, to a driven-side gear provided to the developer supply container, a driving-side gear provided in the apparatus main assembly is connected. Then, the driving force is transmitted from the apparatus main assembly to the developer supply container, so that the developer in the developer supply container is stirred and fed to supply the developer to the developing device (Japanese Laid-Open Patent Application (JP-A) 2010-256893).

Here, in the case of a constitution using developers of a plurality of colors as in a full-color image forming apparatus, the developer is supplied from the developer supply container for an associated color to the developing device for the associated color. In such a constitution, each of the developer supply containers may be driven by an associated driving source, but from the viewpoints of downsizing and cost reduction of the apparatus, two developer supply containers may desirably be driven by a single driving source.

For this reason, e.g., it would be considered that the following constitution is employed. That is, a rotatable swinging member swung and rotated by the single driving source is provided. Then, by switching a rotational drive direction of the single driving source, both a switching operation for switching a power transmission path to each of the two developer supply containers and a driving operation for driving the two developer supply containers are performed by the single driving source. However, when each of the two developer supply containers is intended to be driven by swinging the rotatable swinging member, the drive directions of the two developer supply containers cannot be aligned with each other. When the drive directions of the two developer supply containers are different from each other, there is a need to employ different constitutions of the two developer supply containers, so that a cost is increased. On the other hand, it would be considered that the drive directions of the two developer supply containers are aligned with each other by providing an intermediary transmitting member (idle gear) between either one of the developer supply containers and the rotatable swinging member (e.g., a gear train). However, in this case, when the idle gear is fixed, there is a possibility that a mounting and demounting operation of the developer supply container is not readily performed smoothly such that when the developer supply container is mounted in and demounted from the apparatus main assembly, engagement (meshing) of the gears is not readily made smoothly.

SUMMARY OF THE INVENTION

The present invention has been accomplished in view of the above circumstances. A principal object of the present invention is to provide an image forming apparatus capable of realizing a constitution which can smoothly perform an operation for mounting and demounting two developer supply containers relative to an apparatus main assembly in a structure in which an intermediary transmitting member is provided between one of the two developer supply containers and a rotatable swinging member and in which the two developer supply containers can be driven by a single driving source.

According to an aspect of the present invention, there is provided an image forming apparatus comprising: a single driving source for driving first and second supply containers each for supplying a developer to a developing device; and a drive switching device for switching a drive transmission path so that power from the driving source is selectively transmittable to the first and second supply containers, wherein the drive switching device includes: a rotatable driving member rotatable in a normal direction and a reverse direction by switching a driving direction of the driving direction; a rotatable swinging member rotatable by rotation of the rotatable driving member and swingable between a first connected position where the rotatable swinging member is connected, by rotation of the rotatable driving member in a first direction, with the first supply container to permit drive transmission and a first retracted position where the rotatable swinging member is retracted from the first supply container by rotation of the rotatable driving member in a second direction opposite to the first direction; and a rotatable moving member movable between a second connected position where the rotatable moving member is connected, by rotation of the rotatable driving member in the second direction, with the second supply container to permit drive transmission from the rotatable swinging member swung to the first retracted position to the second supply container and a second retracted position where the rotatable moving member is retracted from the second supply container by rotation of the rotatable driving member in the first direction.

These and other objects, features and advantages of the present invention will become more apparent upon a consideration of the following description of the preferred embodiments of the present invention taken in conjunction with the accompanying drawings.

DESCRIPTION OF THE INVENTION

Figure 1:
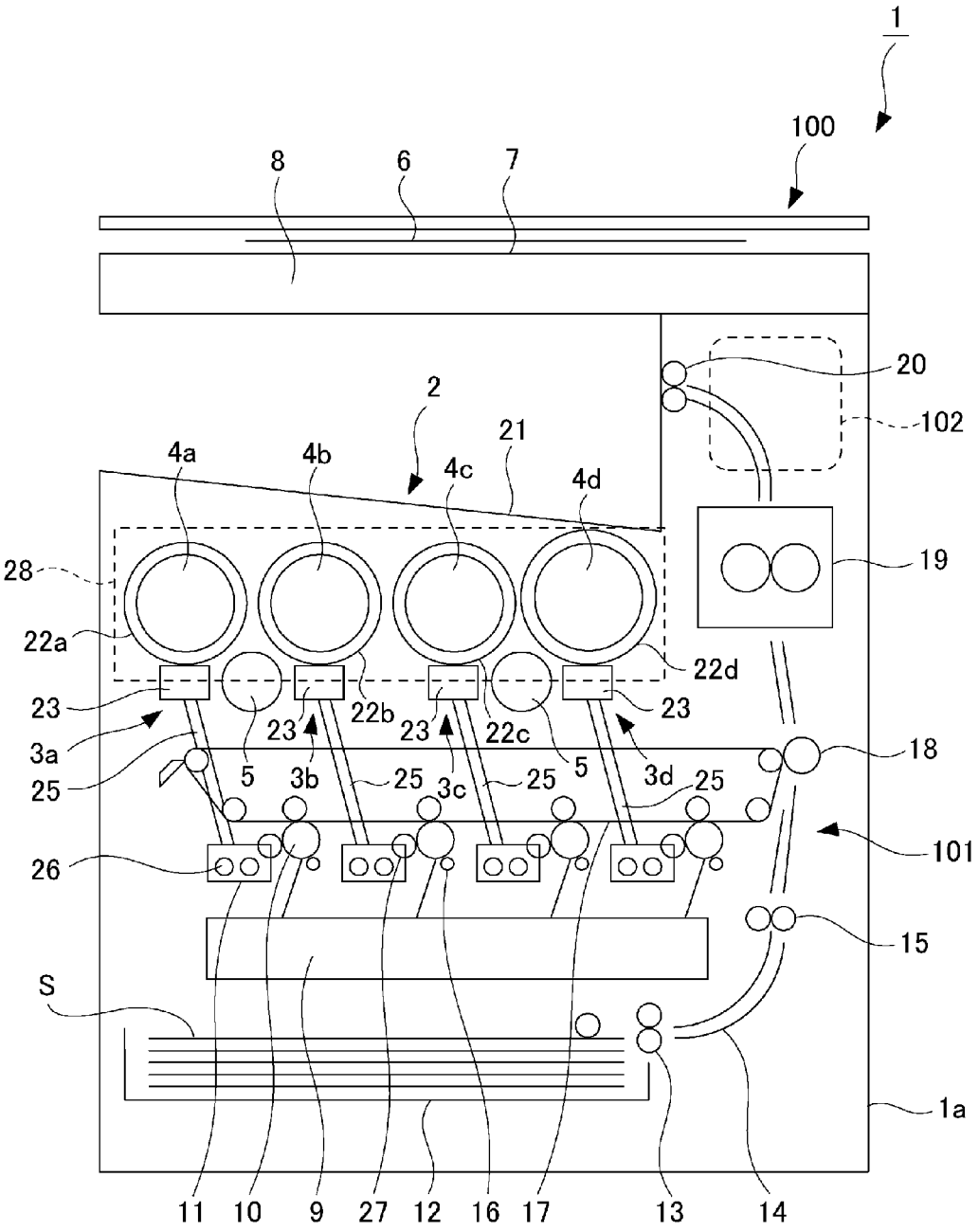
FIG. 1 is a schematic sectional view of an image forming apparatus according to an Embodiment of the present invention.

An Embodiment of the present invention will be described with reference to FIGS. 1 to 8. First, with reference to FIG. 1, a general structure of an image forming apparatus 1 in this embodiment will be described.

[Image Forming Apparatus]

The image forming apparatus 1 in this embodiment employs an electrophotographic type and a constitution in which developer supply containers (supply containers or toner cartridges) 4*a*-4*d* for respective colors are detachably mountable to an apparatus main assembly 1*a*. Further, the image forming apparatus 1 includes an image reading portion 100 and an image forming portion 101. The image reading portion 100 reads an original 6, placed on an original supporting platen glass 7, by an image sensor 8 and obtains information from the original 6 as image information. The image forming portion 101 has a so-called tandem-type structure in which a plurality of photosensitive members (image bearing members or photosensitive drums) 10 are arranged in a travelling direction of an intermediary transfer belt (intermediary transfer member) 17.

Each of the photosensitive drums 10 is electrically charged by a charger 16, and then is subjected to scanning by a laser scanner 9 on the basis of the image information read by the image reading portion 100 or image information sent from an external terminal, so that an electrostatic latent image is formed on a surface thereof. The electrostatic latent image is developed as a toner image with a toner supplied from a developing device 11. In this embodiment, the developing device is a one-component developing device, and as a developer used, a one-component magnetic toner as a dry powder is used. Further, in the developing devices 11, toners of colors of yellow, magenta, cyan and black, respectively, are accommodated. On the photosensitive drums 10, toner images of the colors of yellow, magenta, cyan and black, respectively, are formed. Incidentally, as the developer for developing the electrostatic latent image, a two-component developer other than the above-described one-component developer may also be used.

The color toner images formed on the respective photosensitive drums 10 are superposedly transferred onto the intermediary transfer belt 17, so that superposed color toner images are formed on the intermediary transfer belt 17.

The toner images formed on the intermediary transfer belt 17 are transferred, at a nip with a transfer roller 18, onto a recording material (e.g., a sheet material such as a sheet or an OPC sheet) S fed from a cassette 12. Specifically, sheets of the recording material S fed one by one by a feeding and separating device 13 are fed to a registration roller pair 15 via a feeding portion 14. By the registration roller pair 15, the recording material S is fed in synchronism with rotation of the photosensitive drums 10 and scanning timing of the laser scanner 9.

The recording material S is fed to a fixing device 19 in a state in which the image is formed thereof, and then is heated and pressed by the fixing device 19, so that the image is fixed on the recording material S. Thereafter, the recording material S on which the image is fixed is discharged on a paper discharge tray 21 through a paper discharging portion 20.

When the toner in each of the developing devices 11 is consumed by forming the image as described above, toner is supplied from associated one of the developer supply containers 4*a*-4*d*, for the respective colors, of a developer supplying portion 2 to associated one of the developing devices 11 for the respective colors. Specifically, in the case where a one-component developing device for carrying out development using the one-component magnetic toner is used, as the developer, the one-component magnetic toner is supplied. Further, in the case where a two-component developing device for carrying out development using a two-component developer containing a magnetic carrier and a non-magnetic toner in mixture is used, as the developer, the non-magnetic toner is supplied. Incidentally, in this case, a constitution in which as the developer, also the magnetic carrier is supplied together with the non-magnetic toner may be employed.

[Developer Supplying Portion]

Figure 2:
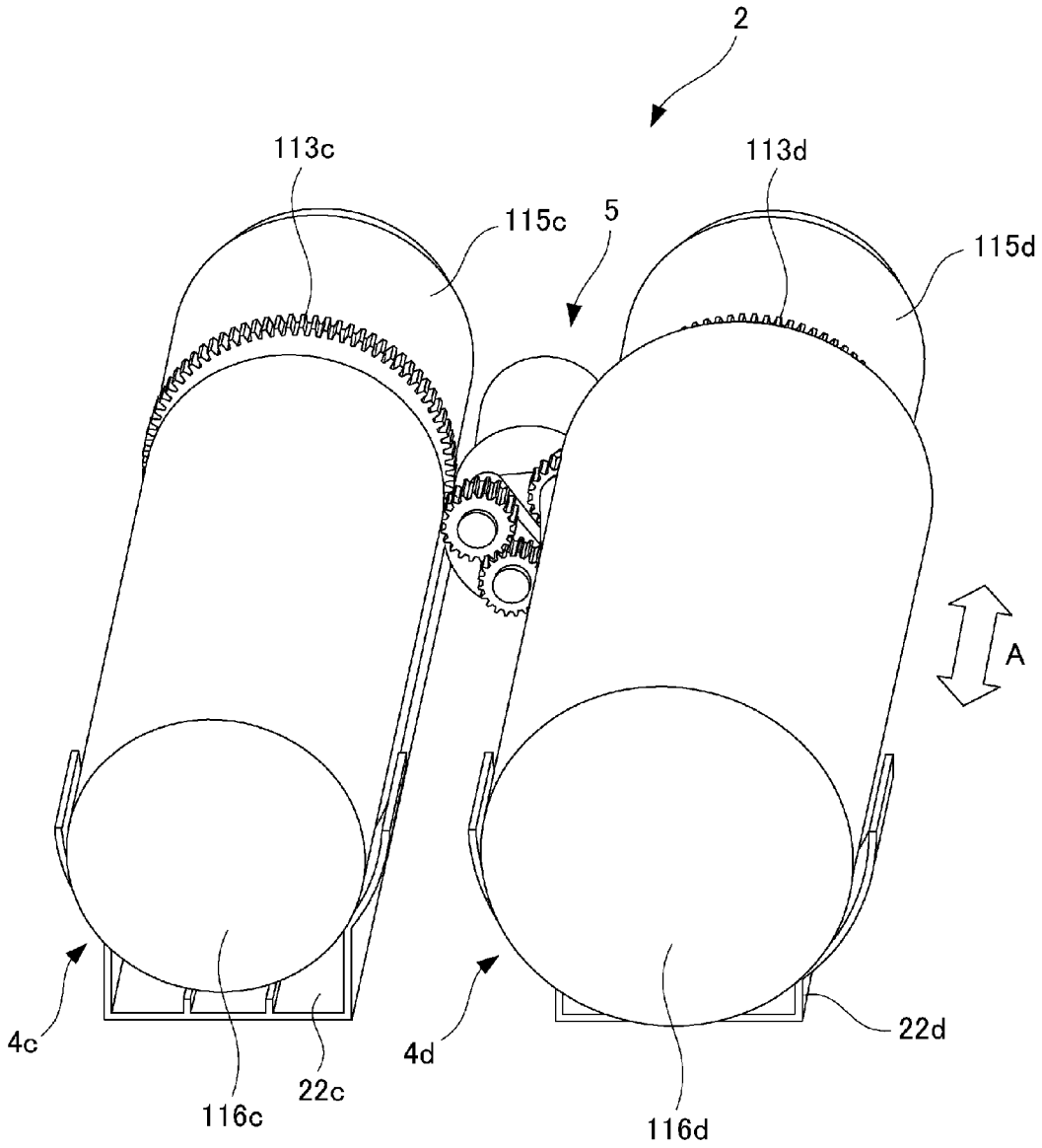
FIG. 2 is a perspective view showing a part of a developer supplying portion in the Embodiment.
Figure 3:
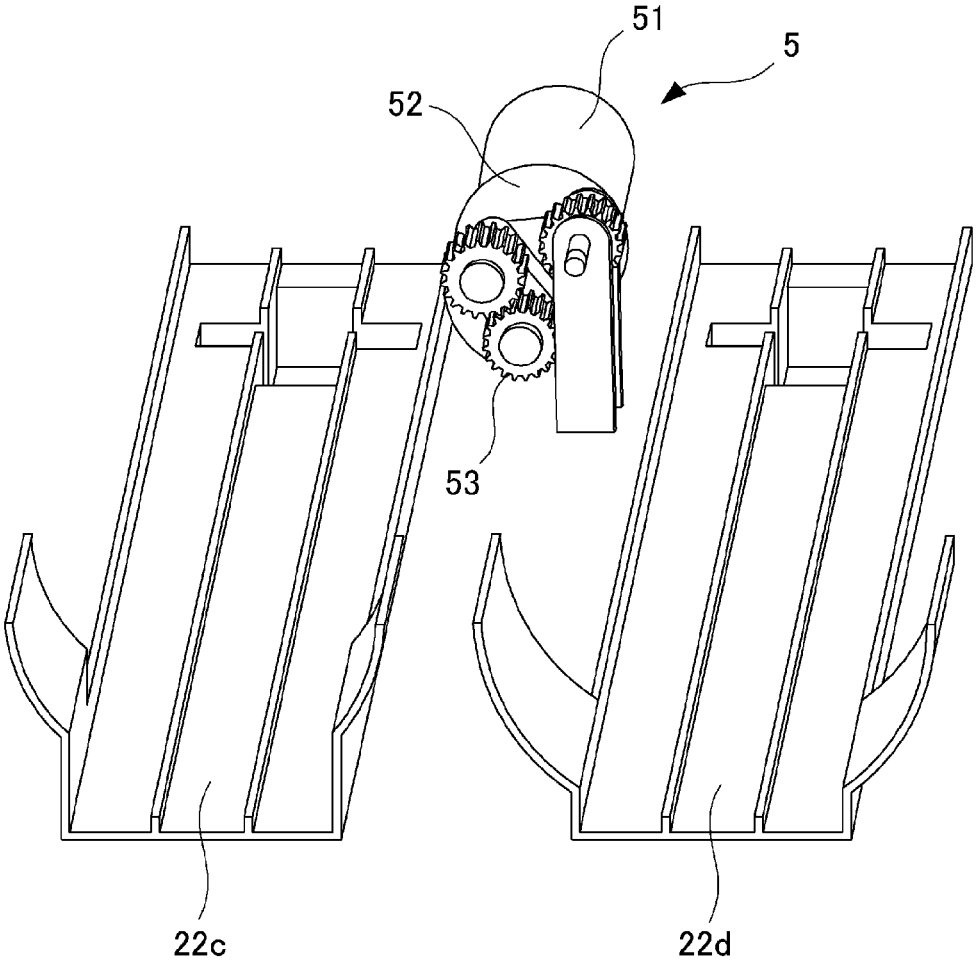
FIG. 3 is a perspective view showing a driving mechanism and a mounting portion for developer supply containers in the Embodiment.
Figure 4:
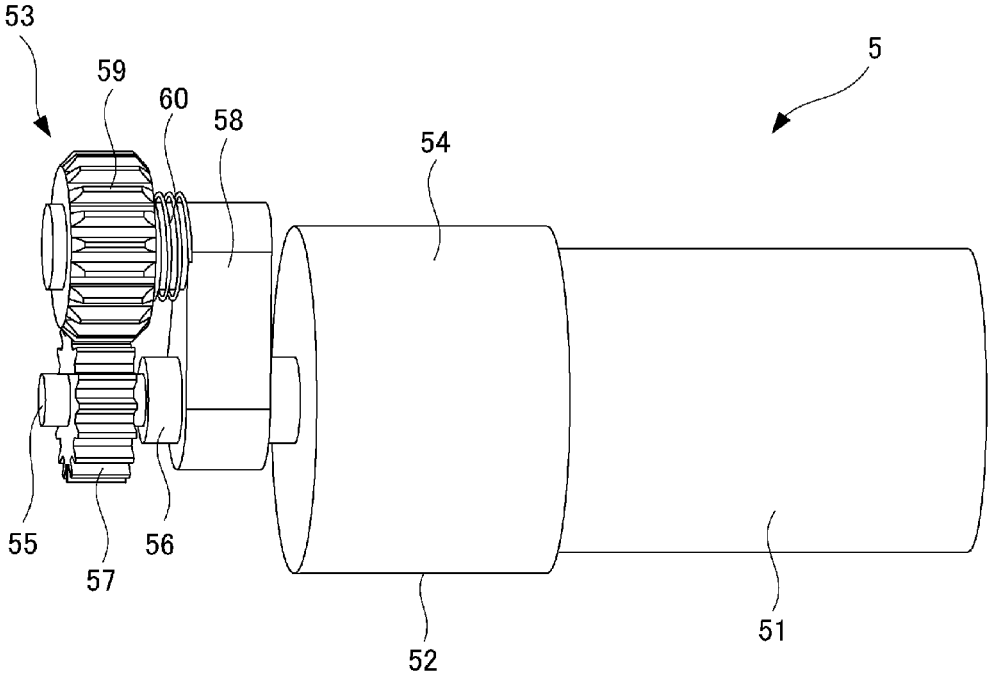
FIG. 4 is a perspective view of the driving mechanism in the Embodiment.

Next, the above-described developer supplying portion 2 will be described with reference to FIG. 1 to FIG. 3. Incidentally, each of FIGS. 2 and 3 shows only a structure of a portion, of the developer supplying portion 2, for supplying the developers of cyan and black. In an example of these figures, an accommodating portion 116*d* of the developer supply container 4*d* for black is made larger than an accommodating portion 116*c* of the developer supply container 4*c* for cyan. A portion for supplying the developers of yellow and magenta has the substantially same structure as the portion for supplying the developers of cyan and black except that a size of each of accommodating portions, for accommodating associated developers, of the developer supply containers 4*a* and 4*b* is equal to the size of the accommodating portion 116*c* for accommodating the developer of cyan.

The developer supplying portion 2 includes the developer supply containers 4*a*-4*d*, a driving mechanism 5, and developer supplying devices 3*a*-3*d* for supplying the developer of the respective colors from the developer supply containers 4*a*-4*d* to the developing devices 11. The developer supplying devices 3*a*-3*d* includes mounting portions 22*a*-22*d*, hoppers 23 and supply paths 25.

The mounting portions 22*a*-22*d* are used for detachably mounting the developer supply containers 4*a*-4*d* thereto and are provided in the apparatus main assembly 1*a*. The developer supply container 4*a*-4*d* are constituted so as to be mounted and demounted relative to the mounting portions 22*a*-22*d* with respect to an arrow A direction (substantially parallel to a rotational axis direction of a drive input gear described later) as shown in FIG. 2. For this reason, the mounting portions 22*a*-22*d* have, as shown in FIG. 3, a guide shape such that the developer supply container 4*a*-4*d* are capable of being inserted and pulled in associated rotational axis directions. The hoppers 23 temporarily store the developers discharged from the developer supply containers 4a-4d mounted on the mounting portions 22a-22d. The supply paths 25 are used for feeding the color developers, discharged from the developer supply containers 4a-4d and stored in the hoppers 23, toward the developing devices 11.

The driving mechanism 5 is constituted by a motor 51 as a single driving source, a speed reducer 52 and a drive switching mechanism 53 as a drive switching means. Such a driving mechanism 5 is provided between the yellow developer supply container 4a and the magenta developer supply container 4b and between the cyan developer supply container 4c and the black developer supply container 4d. Further, the developer supply containers 4a and 4b are drivable by associated one motor 51, and the developer supply containers 4c and 4d are drivable by associated one motor 51. In this embodiment, the developer supply containers 4a and 4b correspond to a first supply container, and the developer supply containers 4c and 4d correspond to a second supply container. A specific structure of the driving mechanism 5 and a power transmitting operation from the driving mechanism toward the respective developer supply containers will be described later.

The developer supply containers 4a-4d has the same structure as the developer supply container described above in JP-A 2010-256893. That is, each of the developer supply containers 4a-4d includes a cylindrical portion and a pump portion, and the cylindrical portion and the pump portion accommodate the developer therein and are rotationally driven by the driving mechanism 5. The cylindrical portion feeds the developer accommodated therein by being rotationally driven. The pump portion is formed in a bellow shape and is changed in volume by being rotationally driven, so that the pump portion discharges the developer, fed from the cylindrical portion, toward the hopper 23. In this embodiment, the cylindrical portion and the pump portion which accommodate the developer therein constitute the accommodating portion.

Further, each of the developer supply containers includes the drive input gear as a rotatably driven member to be rotationally driven in the case where the power is transmitted from the drive switching mechanism 53 of the driving mechanism 5. That is, as shown in FIG. 2, the developer supply container 4c as the first supply container includes a drive input gear 113c as a first rotatable driven member, and the developer supply container 4d as the second supply container includes a drive input gear 113d as a second rotatable driven member. Although being omitted from illustration, the developer supply container 4a as the first supply container includes the drive input gear as the first rotatable driven member, and the developer supply container 4b as the second supply container includes the drive input gear as the second rotatable driven member. The drive input gears of the developer supply containers 4a-4d have the same specifications, such as a pitch circle and the number of teeth.

Further, in the case of this embodiment, the developer supply containers 4c and 4d include end portions 115c and 115d having the same size and the drive input gears 113c and 113d having the same size, but include the accommodating portions 116c and 116d, for accommodating the developers, different in thickness (size) from each other. That is, the accommodating portion 116d of the black developer supply container 4d is made larger than the accommodating portion 116c of the cyan developer supply container 4c. The reason why the accommodating portion 116c for black is made large is that an amount of consumption of the black developer is larger than those of other developers, and therefore the accommodating portion 116c is permitted to accommodate the developer in a larger amount than those of other developers. Specifically, a cross-section, of the accommodating portion 116d, perpendicular to a rotation shaft of the drive input gear 113d of the accommodating portion 116d is made larger than a cross-section, of the accommodating portion 116c, perpendicular to a rotation shaft of the drive input gear 113c of the accommodating portion 116c. Accordingly, the accommodating portion 116c of the developer supply container 4c as the first supply container corresponds to a first accommodating portion, and the accommodating portion 116d of the developer supply container 4d as the second supply container corresponds to a second accommodating portion.

Incidentally, each of the developer supply containers 4a-4d may also have, e.g., a structure, other than the above-described constitution in which the accommodating portion is rotated, such that a screw for feeding the developer is provided therein. In this case, the developer is supplied into the developing device 11 by rotational drive of the screw.

In either case, to the developer supply containers 4a-4d mounted in the apparatus main assembly 1a, when the developer is needed, a driving force is transmitted by the driving mechanism 5. When the driving force is transmitted, by the above-described developer discharging mechanisms of the developer supply containers 4a-4d, the developers are supplied into the hoppers 23. The developers discharged from the developer supply containers 4a-4d and stored in the hoppers 23 are fed into the developing devices 11 via the supply paths 25. The developers fed to the developing devices 11 are fed to developing rollers 27 by stirring and feeding members 26, and are supplied from the developing rollers 27 to the photosensitive drums 10 during the development.

[Mounting and Demounting of Developer Supply Containers]

Next, mounting and demounting of the developer supply containers 4a-4d will be described. First, in the case where the developer supply containers 4a-4d are mounted in the apparatus main assembly 1a, a user opens an exchanging (replacing) cover 28 in the apparatus main assembly 1a. Then, the developer supply containers 4a-4d are inserted into and mounted on the mounting portions 22a-22d of the developer supplying devices 3a-3d. Thereafter, the user closes the exchanging cover 28, so that a mounting step is ended.

On the other hand, in the case where the developers in the developer supply containers 4a-4d become empty, the user opens the exchanging cover 28 and then takes out the developer supply containers 4a-4d from the mounting portions 22a-22d. Then, new developer supply containers 4a-4d which are prepared in advance are inserted into and mounted on the mounting portions 22a-22d, and then the user closes the exchanging cover 28, so that an exchanging (replacing) operation from demounting to remounting of the developer supply containers 4a-4d is ended. Details of the mounting and demounting operation of the developer supply containers will be described later.

[Driving Mechanism]

Next, the driving mechanism 5 for driving the developer supply containers 4a-4d will be specifically described with reference to FIGS. 2-8. In the following, a relationship between the developer supply containers 4c and 4d and the driving mechanism 5 disposed between these developer supply containers 4c and 4d will be described. Incidentally, the driving mechanism 5 disposed between the developer supply containers 4*a* and 4*b* has the same constitution as the driving mechanism 5 disposed between the developer supply containers 4*c* and 4*d*. Therefore, a relationship between the developer supply containers 4*a* and 4*b* and the driving mechanism 5 disposed between these developer supply containers 4*a* and 4*b* is the same as the relationship between the developer supply containers 4*c* and 4*d* and the driving mechanism 5 disposed between these developer supply containers 4*c* and 4*d*.

The driving mechanism 5 is constituted by the motor 51, the speed reducer 52 and the drive switching mechanism 53. The motor 51 is provided with an unshown pinion gear for transmitting the driving force. The speed reducer 52 is constituted by a plurality of unshown gears, a speed-reducing frame 54, an output shaft 55, and a swingable sleeve 56 which is formed as a part of the speed-reducing frame 54 and which is provided coaxially with the output shaft 55, and the motor 51 is mounted to the speed reducer 52.

The drive switching mechanism 53 is constituted so that a power transmitting path from the motor 51 as the single driving source can be switched toward either one of the developer supply containers 4*c* and 4*d*. For this reason, the drive switching mechanism 53 is constituted by an output gear 57, a swingable arm 58, a driving gear 59, a brake spring 60, a movable gear 61 and a movable gear frame 62 as shown in FIGS. 4-8. In the case of this embodiment, the drive switching mechanism 53 is disposed so that the output gear 57 is positioned closer to the developer supply container 4*c* than the developer supply container 4*d*. Further, drive transmission to the drive input gear 113*c* of the developer supply container 4*c* is made from the output gear 57 via the swingable gear 59. On the other hand, drive transmission to the drive input gear 113*d* of the developer supply container 4*d* is made from the gear 57 via the swingable gear 59 and the movable gear 61.

The output gear 57 as a rotatable driving member is fixed coaxially with the output shaft 55, and is rotationally driven in a normal direction (normal rotation) and a reverse direction (reverse rotation) via the speed reducer 52 by switching a drive direction of the motor 51. The swingable gear 59 as a rotatable swinging member engages with the output gear 57 and is rotated by rotation of the gear 57. Further, the swingable gear 59 is rotatably supported by the swingable arm 58. The swingable arm 58 is swingable about the swingable sleeve 56, i.e., is swingable about a rotation shaft of the output gear 57, so that the gear 57 and the swingable gear 59 are connected with each other so as to permit the drive transmission.

Figure 5:
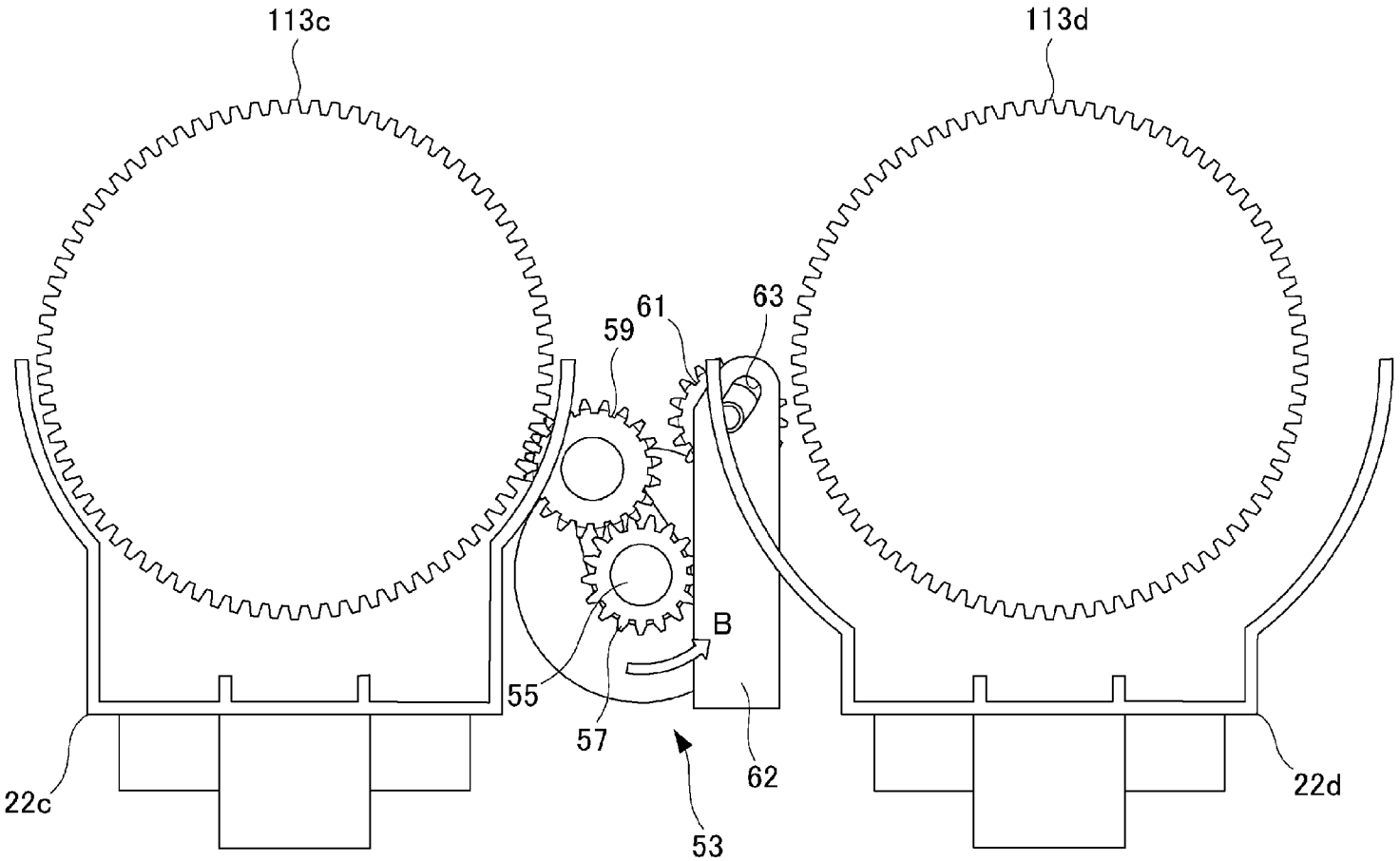
FIG. 5 is a schematic sectional view showing the developer supplying portion in a state in which a swingable gear is connected with a drive input gear.
Figure 6:
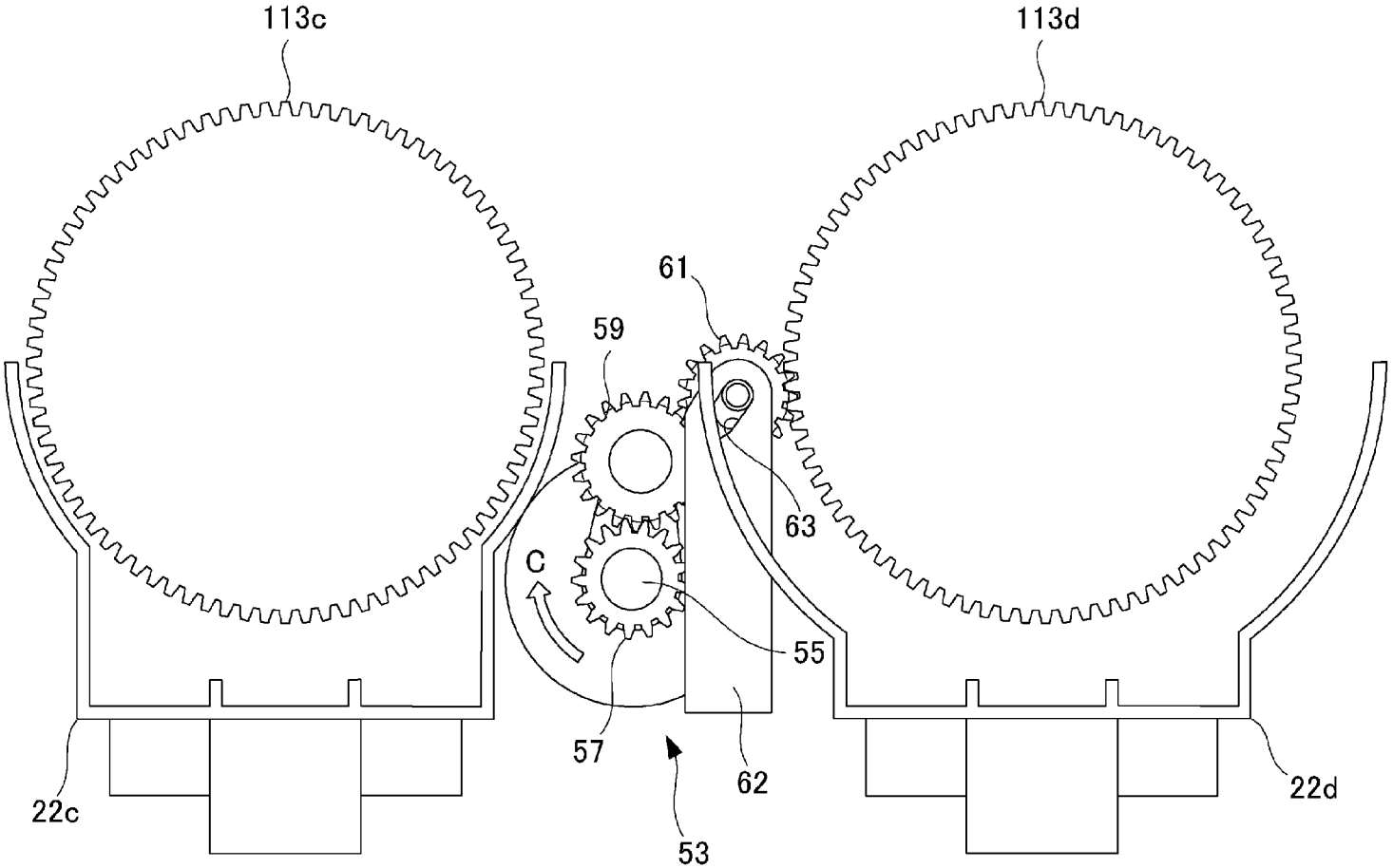
FIG. 6 is a schematic sectional view showing the developer supplying portion in a state in which a movable gear is connected with the drive input gear.

The swingable gear 59 is swingable between a first connected position and a first retracted position. The first connected position is a position where the swingable arm 58 is swung by rotation of the output gear 57 in a first direction (arrow B direction), so that the swingable gear 59 is connected with the drive input gear 113*c* of the developer supply container 4*c* to permit the power transmission as shown in FIG. 5. The first retracted position is a position where the swingable arm 58 is swung in a direction opposite to the swing direction of FIG. 5 by rotation of the output gear 57 in a second direction (arrow C direction) opposite to the first direction, so that the swingable gear 59 is retracted from the drive input gear 113*c* as shown in FIG. 6. At the first retracted position shown in FIG. 6, the swingable gear 59 is connected with the movable gear 61 as a rotatable moving member.

In an engaging region where the swingable gear 59 is engaged with the drive input gear 113*c*, an angle formed between a movement locus of the swingable gear 59 and a tangential line of a pitch circle of the drive input gear 113*c* in the engaging region is made substantially equal to or smaller than a pressure angle of the gear. As a result, during the power transmission, the engagement between the swingable gear 59 and the drive input gear 113*c* is made less disengageable.

Further, between the swingable gear 59 and the swingable arm 58, the brake spring 60 as a resistance imparting means for imparting a rotational resistance to the swingable gear 59 is held, and the swingable gear 59 receives an urging force from the brake spring 60. As a result, in the case where the swingable gear 59 does not transmit the power to the drive input gear 113*d* via the drive input gear 113*c* and the movable gear 61, rotation of the swingable gear 59 by the rotational drive of the output gear 57 is suppressed. As a result, by the rotation of the output gear 57, the swingable gear 59 is swingable together with the swingable arm 58 along the rotational direction of the output gear 57. Accordingly, a swing direction of the swingable gear 59 is changed by switching the rotational direction of the output gear 57.

Further, when the swingable gear 59 is connected with the drive input gear 113*c* of the developer supply container 4*c*, a force applied to the swingable gear 59 by the driving force of the output gear 57 is directed in a direction of urging the swingable arm 58 toward the drive input gear 113*c*. On the other hand, when the swingable gear 59 is connected with the movable gear 61, the force applied to the swingable gear 59 by the driving force of the output gear 57 is directed in a direction of urging the swingable arm 58 toward the movable gear 61.

The urging force of the brake spring 60 for urging the swingable gear 59 is adjusted so that the swingable gear 59 is rotated by the rotational drive of the output gear 57 in the case where the swingable gear transmits the power to the drive input gear 113*d* via the drive input gear 113*c* or the movable gear 61. Accordingly, in the case where the gear 59 is connected with the drive input gear 113*d* via the drive input gear 113*c* or the movable gear 61, the swingable gear 59 is rotated by the drive of the output gear 57. Then, the drive input gear 113*c* or the movable gear 61 with which the swingable gear 59 is connected, and the drive input gear 113*d* are rotationally driven.

The movable gear frame 62 is provided with a slit 63 for permitting movement of the movable gear 61. The movable gear 61 is rotatable along the slit 63 and is provided movably along the slit 63. Accordingly, the movable gear 61 is movable along the slit 63 between a second connected position where the movable gear 61 is connected with the drive input gear 113*d* of the developer supply container 4*d* to permit the power transmission and a second retracted position where the movable gear 61 is retracted from the drive input gear 113*d*. Further, the movable gear 61 is rotated by the swingable gear 59 which is located at the first retracted position and which is rotationally driven by the output gear 57 as described above. Both end portions of the slit 63 have an arcuate shape so as not to prevent the rotation of the movable gear 61. That is, by the rotation of the output gear 57 in the second direction (arrow C direction in FIG. 6), the movable gear 61 is rotated by the swingable gear 59 swung to the first retracted position, and at the same time, is moved to the second connected position. On the other hand, by the rotation of the output gear 57 in the first direction (arrow B direction in FIG. 5), the movable gear 61 is moved to the second retracted position.

Figure 7:
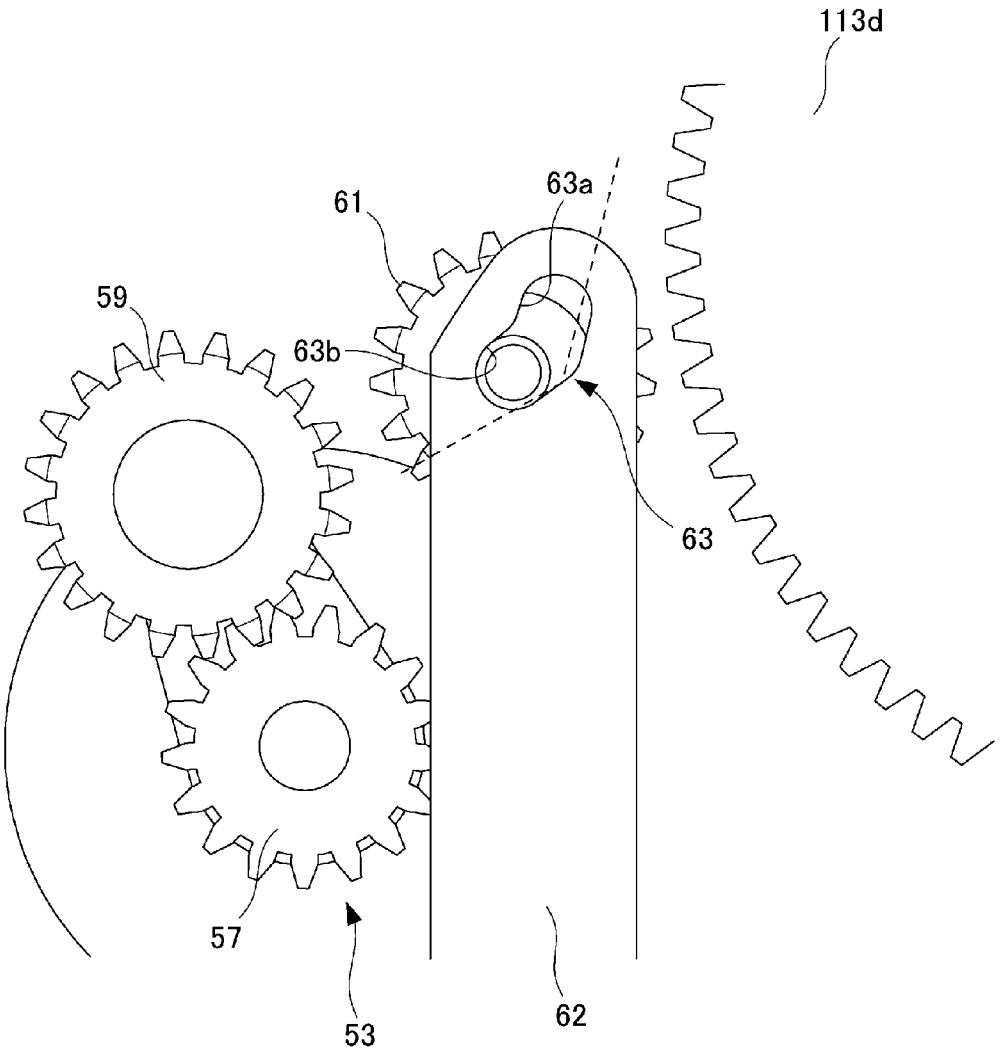
FIG. 7 is a sectional view showing a part of a drive switching mechanism and the drive input gear for illustrating a movement path of the movable gear.

In this way, the slit 63 as a movement path of the movable gear 61 is, as shown in FIG. 7, constituted by at least a first path 63*a* from the second connected position to an intermediary position between the second retracted position and the second connected position, and a second path 63*b* closer to the second retracted position than the intermediary position. The second path 63*b* forms an angle, with a tangential line of the drive input gear 113*d* at a position where the movable gear 61 is connected with the drive input gear 113*d*, larger than an angle formed between the first path 63*a* and the tangential line. That is, in a side (the second path 63*b*) where the movable gear 61 is spaced from the drive input gear 113*d*, compared with a side (the first path 63*a*) where the movable gear 61 approaches the drive input gear 113*d*, the movement locus of the movable gear 61 is such that an angle (providing a small crossing angle) formed between the movable gear 61 and the tangential line of a pitch circle of the drive input gear 113*d* at a drive-connected position is made small. Further, an engaging region where the movable gear 61 is engaged with the drive input gear 113*d*, an angle formed between the movement locus (the firsts path 63*a*) of the movable gear 61 and the tangential line of the pitch circle of the drive input gear 113*d* in the engaging region is made substantially equal to or smaller than a pressure angle of the gear. As a result, during the power transmission, the engagement between the movable gear 61 and the drive input gear 113*d* is made less disengageable. Further, the movement path of the movable gear 61 is constituted by the first and second paths having the two different angles, whereby the movement of the movable gear 61 is made smooth, and at the same time, the engagement of the movable gear 61 with the drive input gear 113*d* is made less disengageable.

Figure 8:
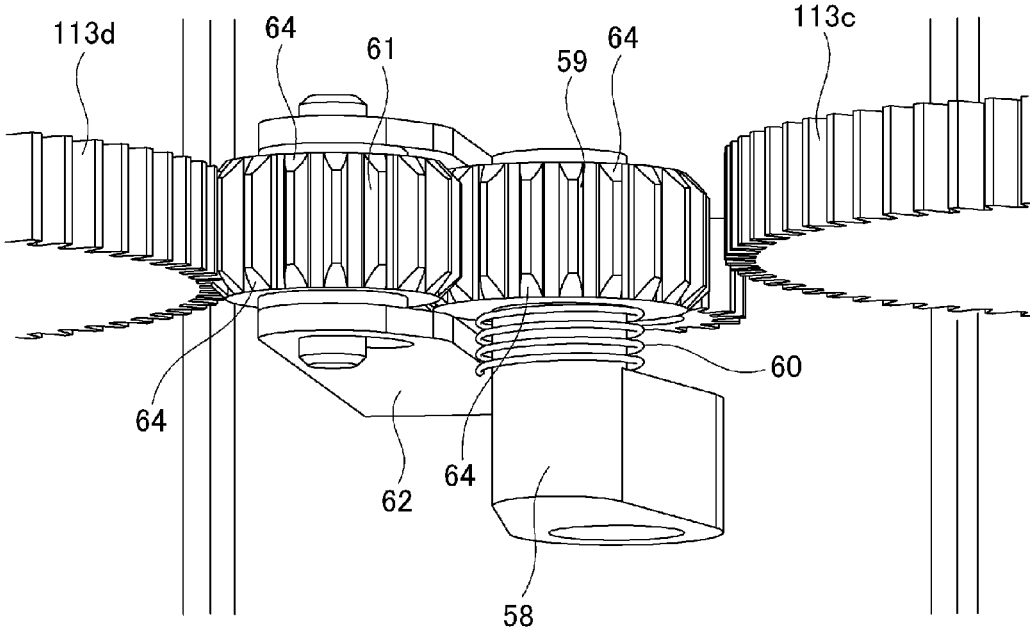
FIG. 8 is an enlarged perspective view showing the drive switching mechanism and the drive input gear.

Each of the drive input gear 113*c*, the drive input gear 113*d*, the output gear 57, the swingable gear 59 and the movable gear 61 described above is constituted by a spur gear. Further, an inclined surface is formed over full circumference at at least one of a rotational axis direction end portion of gear teeth constituting each of the drive input gears 113*c* and 113*d* and a gear rotational axis direction end portion of gear teeth constituting each of the swingable gear 59 and the movable gear 61. This inclined surface is inclined inward with respect to a radial direction at a closer position to the rotational axis direction end portion. In this embodiment, as shown in FIG. 8, the inclined surface 64 is formed over the full circumference at each of the rotational axis direction end portions of the gear teeth constituting each of the swingable gear 59 and the movable gear 61.

Incidentally, the inclined surface 64 may also be formed on either one of the pair of the drive input gears 113*c* and 113*d* and the pair of the swingable gear 59 and the movable gear 61. Further, in the case where the inclined surface is formed on the drive input gears 113*c* and 113*dc*, the inclined surface may only be required to be formed at the rotational axis direction end portions in the swingable gear 59 (rotatable swinging member) side and the movable gear 61 (rotatable moving member) side when the developer supply containers 4*c* and 4*d* are mounted in the apparatus main assembly 1*a*. Similarly, in the case where the inclined surface is formed on the swingable gear 59 and the movable gear 61, the inclined surface may only be required to be formed at the rotational axis direction end portions in the sides where the developer supply containers 4*c* and 4*d* are mounted. Further, each of the drive input gear 113*c*, the drive input gear 113*d*, the output gear 57, the swingable gear 59 and the movable gear 61 may also be a helical gear, and also in this case, similarly, the inclined surface may preferably be formed at the end portion of gear teeth.

[Driving Switching Operation]

A power transmission path switching operation by the drive switching mechanism 53 will be described. First, when the supply of the developer from the developer supply container 4*c* is needed during image formation, ads shown in FIG. 5, by a control device 102 (FIG. 2) of the image forming apparatus 1, the motor 51 is driven so that the rotational direction of the output shaft 55 is an arrow B direction (first direction). At this time, the reducer 52 converts the driving force generated by the motor 51 into proper number of rotations and proper torque and outputs the driving force to the output shaft 55. The driving force transmitted to the output shaft 55 is transmitted from the gear 57 to the swingable gear 59. The swingable gear 59 receives the urging force from the brake spring 60, and therefore has a sliding resistance against rotation. For this reason, when the swingable gear 59 is not connected with the drive input gear 113*c*, the swingable gear 59 is not rotated, and the swingable arm 58 swings until the swingable gear 59 is connected with the drive input gear 113*c*. Incidentally, at this time, the swingable gear 59 is in a state in which the swingable gear 59 is connected with the drive input gear 113*d* via the movable gear 61 or in which the swingable gear 59 is not connected with not only the drive input gear 113*c* but also the drive input gear 113*d*.

When the swingable gear 59 is connected with the drive input gear 113*c*, the driving force is transmitted from the swingable gear 59 to the drive input gear 113*c*, so that the supply of the developer is conducted from the developer supply container 4*c*. At this time, when the driving force is transmitted, in the swing direction of the swingable arm 58, the swingable gear 59 is urged toward the drive input gear 113*c* side by the driving force, and therefore drive connection between the swingable gear 59 and the drive input gear 113*c* is not eliminated. Incidentally, the sliding resistance generated on the swingable gear 59 by the brake spring 60 has a value sufficient to connect the swingable gear 59 with the drive input gear 113*c*, but is sufficiently small when compared with a drive resistance for driving the developer supply container 4*c*. For this reason, the sliding resistance of the brake spring 60 has little influence on the drive of the developer supply container 4*c*.

On the other hand, when the supply of the developer from the developer supply container 4*d* is needed during image formation, ads shown in FIG. 6, by the control device 102, the motor 51 is driven so that the rotational direction of the output shaft 55 is an arrow C direction (second direction). Also at this time, the reducer 52 converts the driving force generated by the motor 51 into proper number of rotations and proper torque and outputs the driving force to the output shaft 55. The driving force transmitted to the output shaft 55 is transmitted from the gear 57 to the swingable gear 59. Then, when the swingable gear 59 is not connected with the drive input gear 113*d* via the movable gear 61, the swingable gear 59 is not rotated by the sliding resistance of the brake spring 60, and the swingable arm 58 swings until the swingable gear 59 is connected with the movable gear 61. Incidentally, at this time, the swingable gear 59 is in a state in which the swingable gear 59 is connected with the drive input gear 113*c* or in which the swingable gear 59 is not connected with not only the drive input gear 113*c* but also the drive input gear 113*d*.

When the swingable gear 59 contacts the movable gear 61, in the case where the movable gear 61 is not connected with the drive input gear 113*d*, the movable gear 61 is pushed by the swingable gear 59 to be moved along the slit 63. Then, a state in which the swingable gear 59, the movable gear 61 and the drive input gear 113*d* are connected is created. At this time, the movement path of the movable gear 61 by the slit 63 is regulated (limited) as described above, and therefore the connection between the movable gear 61 and the drive input gear 113*d* is smoothly performed.

When the connection between the movable gear 61 and the drive input gear 113*d* is completed, the driving force is transmitted from the swingable gear 59 to the drive input gear 113*d* via the movable gear 61, so that the supply of the developer is conducted from the developer supply container 4*d*. At this time, when the driving force is transmitted, in the swing direction of the swingable arm 58, the swingable gear 59 is urged toward the drive input gear 113*d* side by the driving force. For this reason, drive connection from the swingable gear 59 to the drive input gear 113*d* via the movable gear 61 is not eliminated. Incidentally, the sliding resistance generated on the swingable gear 59 by the brake spring 60 has a value sufficient to connect the swingable gear 59 and the movable gear 61 with the drive input gear 113*d*, but is sufficiently small when compared with a drive resistance for driving the developer supply container 4*d*. For this reason, the sliding resistance of the brake spring 60 has little influence on the drive of the developer supply container 4*d*.

In this way, in the case of this embodiment, the drive input gear 113*c* of the developer supply container 4*c* is driven by the driving force transmitted from the gear 57 via the swingable gear 59. On the other hand, the drive input gear 113*d* of the developer supply container 4*d* is driven by the driving force transmitted from the gear 57 via the swingable gear 59 and the movable gear 61. Accordingly, the drive input gears 113*c* and 113*d* are rotated in the same direction irrespective of the rotational direction of the output shaft 55 since the number of gears for transmitting the driving force from the output gear 1 is different between the drive input gears 113*c* and 113*d* by 1. That is, the rotational direction of the drive input gear 113*c* in the case where the output gear 57 is rotated in the arrow B direction in FIG. 5 and the rotational direction of the drive input gear 113*d* in the case where the output gear 57 is rotated in the arrow C direction in FIG. 6 are the same. For this reason, the developer supply container 4*c* and the developer supply container 4*d* can employ the same mechanism as the container. In this case, the sizes of the accommodating portions of the developer supply containers 4*c* and 4*d* may be different from each other. As a result, cost reduction of the apparatus can be realized.

Further, as a drive constitution of the drive input gears 113*c* and 113*d* to be rotated in the same direction via the swingable gear 59, the drive constitution from the output gear 57 to each of the drive input gears 113*c* and 113*d* is realized by a minimum gear constitution. For this reason, downsizing and cost reduction of the image forming apparatus 1 are realized.

[Mounting and Demounting Operation of Developer Supply Container]

Next, the mounting and demounting operation of each of the developer supply container 4*c* and 4*d* relative to the apparatus main assembly 1*a* will be described. The developer supply container 4*c* is detachably mountable to the apparatus main assembly 1*a* with respect to the rotational axis direction along the guide shape of the mounting portion 22*c* as described above. When the developer supply container 4*c* is demounted from the apparatus main assembly 1*a*, there is the case where the swingable gear 59 is engaged with the drive input gear 113*c* of the developer supply container 4*c*. Even in this case, the swingable gear 59 and the drive input gear 113*c* are the spur gears and thus are smoothly slidable with each other, and therefore the connection between the gears is smoothly eliminated, so that the developer supply container 4*c* can be demounted.

However, in the case of this embodiment, even in the case where the swingable gear 59 and the drive input gear 113*c* are the helical gears, the developer supply container 4*c* can be demounted. That is, when the drive input gear 113*c* is moved in a demounting direction of the developer supply container 4*c*, the swingable arm 58 is swung in a direction in which the swingable gear 59 is retracted from the drive input gear 113*c*, and therefore the connection between the gears is smoothly eliminated, so that the developer supply container 4*c* can be demounted. At this time, the output gear 57 is connected with the output shaft 55 of the reducer 52 in rest, and the swingable gear 59 is urged by the brake spring 60. For this reason, the sliding resistance is generated against the swing of the swingable arm 58, but is sufficiently small against a force for retracting the swingable gear 59 by the drive input gear 113*c*, and therefore the sliding resistance little prevents smooth demounting of the developer supply container 4*c*.

When the developer supply container 4*c* is mounted in the apparatus main assembly 1*c*, the drive input gear 113*c* of the developer supply container 4*c* abuts against the swingable gear 59. That is, the drive input gear 113*c* abuts against the swingable gear 59 when phases of these gears are not in mesh positions. At this time, at the teeth end portions of the swingable gear 59, the inclined surface 64 is formed, and therefore a force applied from the drive input gear 113*c* to the swingable gear 59 during the connect therebetween is liable to be converted into a force for retracting the swingable gear 59 from the drive input gear 113*c* by swinging the swingable gear 59. Further, the swingable gear 59 is retracted, so that the developer supply container 4*c* is smoothly mounted in the apparatus main assembly 1*a*. At this time, the output gear 57 is connected with the output shaft 55 of the speed reducer 52 is rest, and the swingable gear 59 is urged by the brake spring 60. For this reason, the sliding resistance is generated against the swing of the swingable arm 58, but is sufficiently small against the force for retracting the swingable gear 59 from the drive input gear 113*c*, and therefore the sliding resistance little prevents smooth demounting of the developer supply container 4*c*.

On the other hand, the developer supply container 4*d* is detachably mountable to the apparatus main assembly 1*a* with respect to the rotational axis direction along the guide shape of the mounting portion 22*d*. When the developer supply container 4*d* is demounted from the apparatus main assembly 1*a*, there is the case where the swingable gear 59 is engaged with the drive input gear 113*d* of the developer supply container 4*d* via the movable gear 61. Even in this case, each of the gears are the spur gears and thus are smoothly slidable with each other, and therefore the connection between the movable gear 61 and the drive input gear 113*d* is smoothly eliminated, so that the developer supply container 4*d* can be demounted.

Further, even in the case where the movable gear 61 and the drive input gear 113*d* are the helical gears, the developer supply container 4*d* can be demounted. That is, when the drive input gear 113*d* is moved in a demounting direction of the developer supply container 4*d*, the movable gear 61 moves along the slit 63 in a direction in which the movable gear 61 is retracted from the drive input gear 113*d*. Then, by being pushed by the movable gear 61, the swingable arm 58 is swung in a direction in which the swingable gear 59 is retracted from the drive input gear 113*d*, and therefore the connection between the movable gear 61 and the drive input gear 113*d* is smoothly eliminated, so that the developer supply container 4*d* can be demounted. At this time, the output gear 57 is connected with the output shaft 55 of the reducer 52 in rest, and the swingable gear 59 is urged by the brake spring 60. For this reason, the sliding resistance is generated against the swing of the swingable arm 58, but is sufficiently small against a force for retracting the movable gear 61 and the swingable gear 59 by the drive input gear 113*d*, and therefore the sliding resistance little prevents smooth demounting of the developer supply container 4*c*.

When the developer supply container 4*d* is mounted in the apparatus main assembly 1*c*, the drive input gear 113*d* of the developer supply container 4*d* abuts against the movable gear 61. That is, the drive input gear 113*d* abuts against the movable gear 61 when phases of these gears are not in mesh positions. At this time, at the teeth end portions of the movable gear 61, the inclined surface 64 is formed, and therefore a force applied from the drive input gear 113*d* to the movable gear 61 during the connect therebetween is liable to be converted into a force for retracting the movable gear 61 from the drive input gear 113*d* by swinging the swingable gear 59 by an operation in which the movable gear 61 is retracted and then pushes the swingable gear 59. Further, by the retraction of the movable gear 61, so that the developer supply container 4*d* is smoothly mounted in the apparatus main assembly 1*a*. At this time, the output gear 57 is connected with the output shaft 55 of the speed reducer 52 is rest, and the swingable gear 59 is urged by the brake spring 60. For this reason, the sliding resistance is generated against the swing of the swingable arm 58, but is sufficiently small against the force for retracting the movable gear 61 from the drive input gear 113*d*, and therefore the sliding resistance little prevents smooth demounting of the developer supply container 4*c*.

Further, as shown in FIG. 7, the slit 63 along which the movable gear 61 moves includes the second path 63*b* having an angle, with respect to a tangential line of the drive input gear 113*d* at a position where the movable gear 61 is connected with the drive input gear 113*d*, larger than a corresponding angle of the first path 63*a*. For this reason, when the movable gear 61 is retracted from the drive input gear 113*d*, the movable gear 61 is guided along the second path 63*b*, whereby the movable gear 61 can be retracted from the drive input gear 113*d* with reliability.

In this way, in the case of this embodiment, the swingable gear 59 for transmitting the power to the drive input gear 113*c* by being connected with the drive input gear 113*c* is swung, so that the power is transmitted from the swingable gear 59 to the drive input gear 113*d* via the movable gear 61. For this reason, the developer supply containers 4*c* and 4*d* can be driven (rotated) in the same direction by the motor 51 as the single driving source.

Further, the swingable gear 59 and the movable gear 61 can be retracted from the drive input gear 113*c* and the drive input gear 113*d*, respectively, and therefore the mounting and demounting operation of the developer supply containers 4*c* and 4*d* relative to the apparatus main assembly 1*a* can be performed smoothly. That is, when the developer supply containers 4*c* and 4*d* are mounted in the apparatus main assembly 1*a*, even in the case where the gears abut against each other, the swingable gear 59 and the movable gear 61 are retracted from the drive input gears 113*c* and 113*c*, respectively, so that the mounting operation can be smoothly performed. Further, in the case where the developer supply containers 4*c* and 4*d* are demounted from the apparatus main assembly 1*a*, even when the respective gears are the helical gears, the swingable gear 59 and the movable gear 61 are retracted from the drive input gears 113*c* and 113*d*, so that the demounting operation can be smoothly performed.

Other Embodiments

Figure 9:
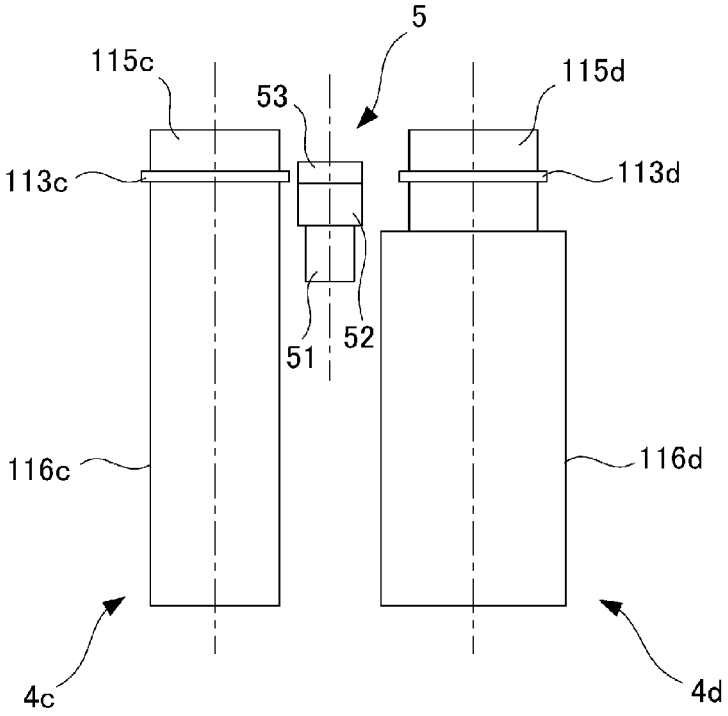
FIG. 9 is a schematic plan view showing a developer supplying portion in another Embodiment of the present invention.

In the case of the Embodiment described above, the motor 51 of the drive mechanism 5 is disposed between the end portions 115*c* and 115*d* of the developer supply containers 4*c* and 4*d*. The end portions 115*c* and 115*d* have the same thickness (size) and therefore do not readily have a constraint on arrangement of the motor 51. On the other hand, as shown in FIG. 9, it would be considered that the motor 51 is disposed between accommodating portions 116*c* and 116*d* different in size. In this case, the position of the motor 51 is closer to the smaller accommodating portion 116*c*. As a result, also the position of the output gear 57 is closer to the drive input gear 113*c* of the developer supply container 4*c* than the drive input gear 113*d* of the developer supply container 4*d*.

In the case of such a constitution, a distance from the output gear 57 is further with respect to the drive input gear 113*c* than with respect to the drive input gear 113*d*. Accordingly, similarly as in the above-described case, by disposing the movable gear 61 in the drive input gear 113*d* side, a length of the swingable arm 58 for swinging the swingable gear 59 can be shortened. Here, when the length of the swingable arm 58 is long, when the swingable gear 59 is connected with the drive input gear 113*c*, an angle formed between a locus of movement of the swingable gear 59 and a tangential line of a pitch circle of the drive input gear 113*c* in an engaging region with this locus is liable to become larger than a pressure angle. When the angle of the movement locus of the swingable gear 59 is larger than the pressure angle, during the power transmission, the engagement between the swingable gear 59 and the drive input gear 113*c* is liable to be eliminated. Accordingly, as shown in FIG. 9, in the case where the output gear 57 is disposed closer to the drive input gear 113*c*, the length of the swingable arm 58 is shortened by disposing the movable gear 61 in the drive input gear 113*d* side. As a result, during the power transmission, the engagement between the swingable gear 59 and the drive input gear 113*c* can be made disengageable. Incidentally, the movable gear 61 is guided by the slit 63, and therefore, irrespective of the distance, the angle of the movement locus can be made smaller than the pressure angle.

Further, in the above description, each of the first rotatable driven member, the second rotatable driven member, the rotatable driving member, the rotatable swinging member and the rotatable moving member is constituted by the gear, but may also be constituted by a member, other than the gear, such as a friction wheel for transmitting a rotational force by the friction force. Further, in the above description, in order to swing the swingable gear 59 by the rotation of the output gear 57, the brake spring 60 is provided. However, the swing of the swingable gear 59 may also be carried out by another driving means without being carried out by the output gear 57. In this case, the brake spring 60 can be omitted.

According to the present invention, the power is transmitted from the rotatable swinging member to the second rotatable driven member via the rotatable moving member by swinging the rotatable swinging member for transmitting the power to the first rotatable driven member by connecting the rotatable swinging member to the first rotatable driven member, and therefore, the two developer supply containers can be driven (rotated) in the same direction by the single driving source. Further, the rotatable swinging member and the rotatable moving member are retractable from the first rotatable driven member and the second rotatable driven member, respectively, and therefore the mounting and demounting operation of the two developer supply containers relative to the apparatus main assembly can be performed smoothly.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 159922/2013 filed Jul. 31, 2013, which is hereby incorporated by reference.

What is claimed is:

1. A supplying device comprising:

a first bottle, detachably mountable to a first mounting portion, for accommodating a developer therein;

a second bottle, detachably mountable to a second mounting portion, for accommodating a developer therein;

a first bottle gear, provided on said first bottle, for inputting a driving force for rotating said first bottle;

a second bottle gear, provided on said second bottle, for inputting a driving force for rotating said second bottle;

a driving gear capable of rotating in a normal direction and a reverse direction;

a driving source for driving said driving gear;

a swingable gear swingable about said driving gear depending on rotation of said driving gear, said swingable gear being swingable between a first inputting position where the driving force is inputted into said first bottle in engagement with said first bottle gear and mounted to the first mounting portion, and a first disengaging position where said swingable gear and said first bottle gear are disengaged when said first bottle is mounted to the first mounting portion; and a movable gear movably supported, said movable gear being movable between a second inputting position where the driving force is inputted into said second bottle in engagement with both of said swingable gear located in the first disengaging position and said second bottle gear, and a second disengaging position where said movable gear and said second bottle gear are disengaged when said second bottle is mounted to the second mounting portion.

2. A supplying device according to claim 1, further comprising a resistance imparting member for imparting a rotational resistance to said swingable gear so that when said swingable gear inputs the driving force into said first bottle or said second bottle, said swingable gear is rotatable, and when said swingable gear swings between the first inputting portion and the first disengaging position, said swingable gear is revolved about said driving gear by driving of said driving gear.

3. A supplying device according to claim 1, wherein said driving gear is provided closer to said first bottle than to said second bottle.

4. A supplying device according to claim 1, further comprising a movement path for movably supporting said movable gear, wherein said movement path includes a first path, provided in a second disengaging position side, for guiding said movable gear, and includes a second path, provided in a second inputting position side of the first path, for guiding said movable gear to the second inputting position, and wherein when a tangential line of a circumscribed circle of said second bottle gear in a position where said second bottle gear and said movable gear are engaged with each other is L, an angle formed between the tangential line L and the second path is smaller than an angle formed between the tangential line L and the first path.

5. A supplying device according to claim 1, wherein a rotation axis of said movable gear is provided along a rotational axis of said second bottle gear when said second bottle is mounted and is provided along a mounting and demounting direction of said second bottle gear, and wherein said movable gear has an inclined surface inclined so that a gear diameter decreases toward an upstream side with respect to a mounting direction of said second bottle.

6. A supplying device according to claim 1, wherein said first bottle and said second bottle are driven in the same direction.

7. A supplying device according to claim 1, wherein the second inputting position is provided above the second disengaging position.

8. A supplying device according to claim 1, wherein a rotation axis of said movable gear is provided along a rotational axis direction of said second bottle gear when said second bottle is mounted and is provided along a mounting and demounting direction of said second bottle gear, and wherein said second bottle gear has an inclined surface inclined so that a gear diameter decreases toward a downstream side with respect to a mounting direction of said second bottle.

* * * * *